United States Patent [19]

Kullman et al.

[11] 4,088,443

[45] May 9, 1978

[54] ALUMINUM CHLORHYDROXIDE-PHOSPHORIC ACID CATALYST SYSTEM FOR FLASH CURE TREATMENTS TO GIVE IMPROVED DURABLE-PRESS PROPERTIES IN CELLULOSE-CONTAINING TEXTILES

[75] Inventors: Russell M. H. Kullman, Metairie; Robert M. Reinhardt, New Orleans, both of La.

[73] Assignee: The United States of America as represented by the Secretary of Agriculture, Washington, D.C.

[21] Appl. No.: 656,033

[22] Filed: Feb. 6, 1976

[51] Int. Cl.[2] ..... D06M 13/34; B01J 21/02

[52] U.S. Cl. ..... 8/116 P; 8/184; 8/185; 8/186; 8/187; 252/442; 252/463

[58] Field of Search ..... 8/116 P, 185, 184, 186, 8/DIG. 17, 187; 252/442, 463

[56] References Cited

U.S. PATENT DOCUMENTS

| | | | |
|---|---|---|---|
| 3,909,861 | 10/1975 | Reinhardt et al. | 8/184 |
| 3,954,405 | 5/1976 | North et al. | 8/185 |

*Primary Examiner*—John Kight, III

*Attorney, Agent, or Firm*—M. Howard Silverstein; David G. McConnell; Salvador J. Cangemi

[57] ABSTRACT

An aluminum chlorhydroxide-phosphoric acid catalyst system has been devised that is practical for treatments of cellulose-containing textile materials with formaldehyde and formaldehyde-amide adducts under flash curing conditions to produce valuable, improved durable-press properties in the treated textiles.

7 Claims, No Drawings

ALUMINUM CHLORHYDROXIDE-PHOSPHORIC ACID CATALYST SYSTEM FOR FLASH CURE TREATMENTS TO GIVE IMPROVED DURABLE-PRESS PROPERTIES IN CELLULOSE-CONTAINING TEXTILES

FIELD TO WHICH INVENTION RELATES

This invention relates to durable-press fabrics. More specifically, it relates to a catalyst system that is useful in the treatment of cellulose-containing textile materials with formaldehyde and certain formaldehyde-amide adduct finishing agents to give valuable durable-press textile products.

THE PRIOR ART

Catalyst systems containing aluminum chlorhydroxide and relatively weak inorganic acids such as phosphoric acid or aluminum chlorhydroxide and many organic acids have been demonstrated (by Reinhardt et al., U.S. Pat. No. 3,909,861) to be effective in mild cure finishing and to be synergistically activated. A synergistic interaction occurs so that greater catalysis results from the use of such acids and aluminum chlorhydroxide [$Al_2(OH)_5Cl$] than from either component alone. Systems in which aluminum chlorhydroxide is used either alone or in combination with other materials provide efficient catalysis in conventional processing as well as in certain specialized and unusual treatments. Reinhardt et al., American Dyestuff Reporter 64 (5), 25–26, 28, 30, 32, 42–43 (May 1975), discuss the specialized techniques of moist curing and steam curing and show effective curing temperatures of from 100° to 180° C. In pad-dry-cure finishing, aluminum chlorhydroxide compares favorably with magnesium chloride, zinc chloride, and zinc nitrate as a catalyst for treatments at 140°–160° C. Mixtures of aluminum chlorhydroxide with acids, such as phosphoric acid, permit curing at lower temperatures; also effective moist curing can be accomplished.

In all prior work, aluminum chlorhydroxide alone was used when curing operations were conducted at elevated temperatures of 140° to 180° C. Activation with acids made possible lower curing temperatures and thus decreased fabric strength losses due to degradative effects of acids. Lowered curing temperatures were found effective with either weak or strong acids mixed with aluminum chlorhydroxide.

None of the aluminum chlorhydroxide systems employed in the prior art were suitable for high temperature curing. Many areas of the textile industry today are geared for high speed production and would not permit prolonged curing times in excess of about 60 seconds in finishing operations. In fact, curing times well below 30 seconds are now desirable but no aluminum chlorhydroxide catalyst system, as seen in the prior art, was adaptable to industry needs. All prior processes teach away from rapid, high temperature curing, particularly when an activated system incorporating an acid is employed with aluminum chlorhydroxide.

To our surprise, we have now found that a specific mixture of aluminum chlorhydroxide and phosphoric acid can be very effective in rapid curing at temperatures well above 180° C., the upper limit in prior work when aluminum chlorhydroxide alone served as the catalyst. The rapid, high temperature cure, hereinafter referred to as flash curing, can be accomplished at 200° C. in 15 seconds. One skilled in the art would normally anticipate severe, adverse degradation of fabric from catalyst systems containing acid at such an elevated temperature.

OBJECTS OF THE INVENTION

It is an object of this invention to produce cellulose-containing fabrics with excellent durable-press properties.

It is a further object to provide a catalyst system that is efficient and practical for use in finishing treatments for cellulose-containing textiles.

A still further object is to furnish a catalyst system consisting of aluminum chlorhydroxide and phosphoric acid that will provide effective catalysis on flash curing.

HOW THE OBJECTS ARE ACHIEVED

The objects of this invention are achieved by use of the catalyst system based upon aluminum chlorhydroxide and phosphoric acid in treatments for cellulose-containing textiles with formaldehyde and formaldehyde-amide adduct finishing agents. The specific combination of the aluminum chlorhydroxide and acid provides efficient, rapid catalysis in flash cure processing. Unexpectedly, the system does not increase degradative effects to the textile at the high curing temperatures employed.

The catalyst system offers the textile finisher the ability to achieve certain treatments under processing conditions previously found impossible.

SCOPE OF THE INVENTION

The catalyst system of the present invention is composed of aluminum chlorhydroxide [$Al_2(OH)_5Cl$] and phosphoric acid [$H_3PO_4$] in a specific combination. Concentrations of aluminum chlorhydroxide that may be used are from about 2 millimoles to about 6 millimoles for each 100 g. of treatment bath. The preferred concentration is 3 millimoles of aluminum chlorhydroxide per 100 g. of treatment bath. Phosphoric acid concentration employed should be such that a molar ratio of aluminum chlorhydroxide to phosphoric acid of 3:4 is present. Thus, the range of phosphoric acid concentration will be dependent on the concentration of aluminum chlorhydroxide in the treatment bath.

Crosslinking agents, selected from the group consisting of formaldehyde, dimethylol dihydroxyethyleneurea, dimethylol methyl carbamate, dimethylol isobutyl carbamate, and bis(methoxymethyl)uron, may be used in concentrations ranging from about 7% to about 20%, by weight, of the treatment bath.

Temperatures to achieve flash curing range from about 175° C. to about 215° C. with the preferred temperature of about 200° C. Curing times selected may be from about 10 to about 45 seconds, the shorter times being associated with the higher temperatures. The preferred conditions for flash curing are 15 seconds at 200° C.

The cellulose-containing material may contain 50% or more cellulose and may be in the form of fibers, yarns, or fabric. Fabric is the most suitable form for treatment to achieve durable-press properties.

SUMMARY OF THE INVENTION

In summary, an aluminum chlorhydroxide-phosphoric acid catalyst system was found to be operative at high curing temperatures for very short curing times in treatment of cellulose-containing textiles with finishing agents to produce durable-press products. Short curing times at high temperatures, called flash curing, are employed with use of selected cross-linking agents and the catalyst system. Among suitable finishing agents are formaldehyde, dimethylol dihydroxyethyleneurea, dimethylol methyl carbamate, dimethylol isobutyl carbamate and bis(methoxymethyl)uron. Treatment is accomplished by padding the fabric with the treatment solution, drying the fabric to remove most of the moisture, then flash curing the fabric for 15 seconds or longer at about 200° C.

EXAMPLE 1

An aqueous solution was prepared so that each 100g. contained 10g. of dimethylol methyl carbamate, 3 millimoles of $Al_2(OH)_5Cl$ and 4 millimoles of $H_3PO_4$.

Samples of a 50 cotton/50 polyester sheeting were passed into and through the treatment solution and squeezed through pad rolls to achieve wet pickups of about 85 to 90%. The wet, impregnated fabrics, after being mounted on pin frames, were dried for 7 minutes at 60° C., cured at 150, 175, or 200° C. for the times indicated in Table 1, then machine washed, tumble dried and evaluated.

Table 1

| Curing conditions | | DP rating | | |
|---|---|---|---|---|
| Temperature ° C | Time, seconds | (Tumble dried) | Brk str, W, lbs | % Nitrogen |
| 150 | 30 | 3.7 | 55.3 | 0.51 |
| | 40 | 4.0 | 56.6 | 0.54 |
| | 60 | 3.9 | 56.9 | 0.56 |
| 175 | 30 | 4.5 | 56.7 | 0.50 |
| | 40 | 4.6 | 56.7 | 0.53 |
| | 50 | 4.7 | 56.1 | 0.54 |
| 200 | 15 | 4.6 | 55.3 | 0.53 |
| | 20 | 4.7 | 56.6 | 0.50 |
| | 25 | 4.7 | 54.0 | 0.49 |
| | 40 | 4.7 | 56.8 | 0.55 |
| Untreated | — | 2.7 | 72.8 | 0.02 |

The outstandingly high DP ratings achieved at 200° C. with no adverse effect on fabric strength compared to 175 and 150° C. curing were unexpected and surprising. The lowest curing temperature of 150° C. was obviously not as efficient nor effective as 175° C. curing and even less effective than the 200° C. curing as seen by the DP rating in relation to bound nitrogen in the finished fabrics. Completely satisfactory durable press fabric was obtained with only a 15 second curing time at 200° C. This demonstrates the effectiveness of the catalyst system under flash curing conditions.

EXAMPLE 2

An aqueous solution was prepared so that each 100g. contained 9g. of dimethylol dihydroxyethyleneurea, 4g. of a polyethylene emulsion, and 12.5 millimoles of $Al_2(OH)_5Cl$. Sample A, a white 50 cotton/50 polyester semiprintcloth, Sample B, a white cotton sheeting, Sample C, a white 75 cotton/25 polyester sheeting, and Sample D, a white 65 cotton/35 polyester sheeting were passed into and through the solution and squeezed through pad rolls, then dried for 2 minutes at 93° C., cured for 15 seconds at 200° C. on a tenter frame, then machine washed and tumble dried.

Although the samples had DP ratings of 3.9, 4.2, 4.2, and 3.7 (A,B,C, and D, respectively), all samples were badly yellowed.

The fabric discoloration when only $Al_2(OH)_5Cl$ is used at catalyst in the flash curing process demonstrates that this catalyst alone at the concentration needed to produce DP properties of this level is not suitable at such an elevated temperature. It also demonstrates that reduction to as low as 50% cotton in the fabric has no effect on this discoloration.

EXAMPLE 3

Aqueous solutions were prepared such that each 100g. contained 15g. of dimethylol dihydroxyethyleneurea with:

Sample E — 3 millimoles of $Al_2(OH)_5Cl$;
Sample F — 4 millimoles of $H_3PO_4$;
Sample G — 3 millimoles of $Al_2(OH)_5Cl$ and 4 millimoles of $H_3PO_4$.

Samples of a 50 cotton/50 polyester sheeting were passed into and through the treatment solutions and squeezed through pad rolls to achieve wet pickups of about 80%; the wet, impregnated fabrics, after being mounted on pin frames, were dried for 7 minutes at 60° C., and cured for 15 seconds at 200° C. The treated fabrics were machine washed, tumble dried, and evaluated. Sample E had a DP rating of 3.3, Sample F had a DP rating of 3.9 and Sample G had a DP rating of 4.7. The very high durable press performance of the sample treated with the catalyst system containing both $Al_2(OH)_5Cl$ and $H_3PO_4$ demonstrates the effectiveness of this catalyst as compared to that of either $Al_2(OH)_5Cl$ or $H_3PO_4$.

EXAMPLE 4

Aqueous solutions were prepared such that each 100g. contained 3 millimoles of $Al_2(OH)_5Cl$ and 4 millimoles of $H_3PO_4$ with:

Sample H — 15g. of dimethylol dihydroxyethyleneurea;
Sample I — 9g. of bis(methoxymethyl)uron;
Sample J — 15g. of methylated urea-formaldehyde;
Sample K — 12.5g. of dimethylol isobutyl carbamate; and
Sample L — 7.5g. of formaldehyde.

Samples of a 50 cotton/50 polyester sheeting were passed into and through the treatment solutions and squeezed through pad rolls to achieve wet pickups of about 90%; the wet, impregnated fabrics, after being mounted on pin frames, were dried for 7 minutes at 60° C., cured at 200° C. for the times indicated in Table 2, then machine washed, tumble dried, and evaluated.

Table 2

| Sample | Cure time, seconds | DP rating | % N | Brk str, W, lbs |
|---|---|---|---|---|
| H | 15 | 4.7 | 1.16 | 54.2 |
| | 25 | 4.7 | 0.99 | 55.6 |
| | 40 | 4.5 | 0.98 | 56.1 |
| I | 15 | 4.0 | 0.85 | 56.6 |
| | 30 | 4.4 | 0.79 | 56.8 |
| J | 15 | 3.3 | 2.15 | 53.8 |
| | 30 | 3.3 | 2.14 | 57.3 |
| K | 15 | 4.3 | 0.69 | 57.0 |
| | 30 | 4.4 | 0.63 | 55.1 |
| L | 15 | 4.5 | — | 56.6 |
| | 30 | 4.7 | — | 57.7 |
| Untreated | — | 2.5 | — | 74.8 |

The catalyst system was effective with all finishing agents except the methylated urea-formaldehyde, Sample J, which sample showed only marginal improvement in durable press performance and was slightly stiff.

The results demonstrate that the catalyst system is useful in flash cure finishing operations for as short a curing time as 15 seconds at 200° C. with selected agents but not predictable as to type of agents with which it may be useful.

EXAMPLE 5

31.6g. (150 millimoles) of $Al_2(OH)_5Cl.2H_2O$ were weighed into a beaker, dissolved in 65g. of water, then cooled to about 6–10° C. in an ice bath.

23.1g. of 85% $H_3PO_4$ (200 millimoles) were weighed into a beaker, 50 ml. of water were added and the solution was cooled in an ice bath to about 6–10° C.

The $H_3PO_4$ solution was slowly added to $Al_2(OH)_5Cl$ solution maintaining temperature through immersion of the beaker containing the mixture in an ice bath to rapidly dissipate heat from the exothermic reaction. Water was added until a total solution of 205g. was obtained. The clear solution containing 25% (wt/wt) of catalyst, with a molar ratio of $Al_2(OH)_5Cl$ to $H_3PO_4$ of 3:4 was stable for 7 days at room temperature before any precipitation formed to make the mixture unsuitable for catalytic purposes in textile finishing. This experiment demonstrates that with proper selection of concentration and ratio of the components in the catalyst system, said catalyst system is stable for at least 7 days.

We claim:

1. A process for preparing cellulose-containing textiles with improved durable-press properties comprising:

(a) padding a cellulose-containing fabric with an aqueous solution each 100 parts by weight of which contain 0.3 part to about 1.0 part of $Al_2(OH)_5Cl$ (i.e., about 2 to 6 mmol of $Al_2(OH)_5Cl$ per 100g of solution), 0.75 as many parts by weight of $H_3PO_4$ for each part of $Al_2(OH)_5Cl$, and about 7.5 parts to 15 parts of a finishing agent selected from the group consisting of formaldehyde and formaldehyde-amide adducts;

(b) drying the fabric from (a); and (c) flash curing the fabric from (b).

2. The process of claim 1 wherein the flash cure temperature is about 175°–200° C. for a period of about 15–60 seconds.

3. The process of claim 1 wherein the finishing agent is formaldehyde.

4. The process of claim 1 wherein the finishing agent is dimethylol dihydroxyethyleneurea.

5. The process of claim 1 wherein the finishing agent is dimethylol methyl carbamate.

6. The process of claim 1 wherein the finishing agent is bis(methoxymethyl)uron.

7. The process of claim 1 wherein the finishing agent is dimethylol isobutyl carbamate.

* * * * *